US009624702B1

(12) United States Patent
Faulkner

(10) Patent No.: US 9,624,702 B1
(45) Date of Patent: Apr. 18, 2017

(54) PORT O LOCK

(71) Applicant: RobinBeth Faulkner, Danbury, CT (US)

(72) Inventor: RobinBeth Faulkner, Danbury, CT (US)

( * ) Notice: Subject to any disclaimer, the term of this patent is extended or adjusted under 35 U.S.C. 154(b) by 311 days.

(21) Appl. No.: 14/271,378

(22) Filed: May 6, 2014

(51) Int. Cl.
*E05C 19/18* (2006.01)

(52) U.S. Cl.
CPC ..... *E05C 19/184* (2013.01); *E05C 19/18* (2013.01)

(58) Field of Classification Search
CPC ..... E05C 19/184; E05C 19/003; E05C 19/18; E05C 19/182; E05C 19/188; E05C 17/02; E05C 17/04; E05C 17/047; E05C 17/30; E05C 17/36; E05C 17/365; E05C 17/38; E05C 17/42; E05C 17/54
USPC ..... 292/288, 289, 256, 258, 290, 292, 295, 292/296, 297, 298, 338, 251.5, 253, 292/DIG. 11, DIG. 15, DIG. 16, DIG. 28, 292/DIG. 65
See application file for complete search history.

(56) References Cited

U.S. PATENT DOCUMENTS 1,607,789 A 11/1926 Baker
2,984,510 A * 5/1961 Hoffmann ..... E05C 19/16 292/142
3,451,708 A * 6/1969 Brooks ..... E05C 17/365 292/264
3,897,966 A * 8/1975 Draughon, Sr. ..... E05C 17/365 292/264
4,493,500 A * 1/1985 Stroup ..... E05C 17/365 292/262
4,885,921 A * 12/1989 Sharav ..... E05B 13/001 292/DIG. 2
5,253,908 A * 10/1993 Leonard, III ..... E05C 19/18 292/258
5,501,494 A * 3/1996 Willetts ..... E05C 19/182 292/262
5,542,723 A * 8/1996 Scharf ..... E05C 17/54 292/258
5,794,871 A * 8/1998 Willetts ..... E05B 13/001 292/288
5,810,404 A * 9/1998 Horne ..... E05C 19/182 292/288
5,984,386 A 11/1999 Clemens
6,394,510 B1 * 5/2002 Stewart, III ..... E05B 65/0888 292/264
6,863,319 B1 * 3/2005 Bentley ..... E05C 17/36 292/253
7,316,086 B2 * 1/2008 Schuling ..... G09F 7/18 40/584
7,980,605 B1 7/2011 Fuhrman
8,641,106 B2 * 2/2014 Probasco ..... B64F 1/005 244/1 R (Continued)

OTHER PUBLICATIONS

"Storefront Door Lock Indicator," www.doorware.com, Mar. 13, 2013.*

*Primary Examiner* — Alyson M Merlino

(57) ABSTRACT

A portable lock for public bathroom stalls for providing temporary closure and external visual notification of occupation for public bathroom stalls. The portable lock for public bathroom stalls may generally include housings connected by a connection rod to springs pivoting on pins retained by retaining rings. Magnets may be installed into lids provide simple closure before use and additional tension or mounting fixation in use.

16 Claims, 12 Drawing Sheets

(56) References Cited

U.S. PATENT DOCUMENTS

| | | | | |
|---|---|---|---|---|
| 9,074,395 | B2 * | 7/2015 | Packer | E05C 17/54 |
| 2008/0224484 | A1 * | 9/2008 | Yates | E05C 17/54<br>292/262 |
| 2012/0223535 | A1 * | 9/2012 | Yates | E05C 17/54<br>292/288 |

* cited by examiner

PORT O LOCK

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to a Port O Lock and more specifically it relates to a portable lock for public bathroom stalls for providing temporary closure and external visual notification of occupation for public bathroom stalls.

2. Description of the Related Art

Locks may be useful for protecting privacy. Locks are especially important for protecting the privacy of a person who may be using a public bathroom. It is not uncommon for public restrooms to be poorly maintained and to find restroom stall door locks to be inoperative. This renders the restroom stall difficult and uncomfortable to use because the door will not remain in a closed position.

Anyone who has travelled very much realizes that the maintenance of public restrooms is sporadic at best and it is not at all uncommon that the restroom door lock is inoperative which is not desirable. Since the restroom doors tend to have a biasing action which moves them into an open position, the stall becomes essentially unusable when the door will not stay closed. An effective solution is desirable.

Various attempts have been made to solve the above-mentioned problems such as those found in U.S. Pat. No. 7,980,605 to Stefanie Fuhrman, U.S. Pat. No. 5,984,386 to Sharon A. Clemons, and U.S. Pat. No. 1,607,789 to Gilbert L. Baker. This art is representative of portable lock devices. None of the above inventions and patents, taken either singly or in combination, is seen to describe the invention as claimed.

Ideally, a Port O Lock should provide a portable lock for public bathroom stalls and, yet would operate reliably and be manufactured at a modest expense. Thus, a need exists for a reliable Port O Lock to avoid the above-mentioned problems.

BRIEF SUMMARY OF THE INVENTION

In view of the foregoing disadvantages inherent in the known portable lock art, the present invention provides a novel Port O Lock. The general purpose of the present invention, which will be described subsequently in greater detail, is to provide a portable lock for a bathroom stall which may be easy to install and may also serve to indicate to an individual outside the bathroom that the bathroom is presently in use.

The invention generally relates to a Port O Lock which may comprise a portable lock for public bathroom stalls that comprises housings connected by a connection rod to springs pivoting on pins retained by retaining rings. Magnets may be installed into lids to provide simple closure before use and additional tension or mounting fixation in use. The portable lock for public bathroom stalls may be structured and arranged for providing temporary closure and external visual notification of occupation for public bathroom stalls. As such, the present invention may be designed to provide a portable lock for public bathroom stalls that may provide an external visual indication of an occupied stall. Another object of the present invention is to provide a portable lock for public bathroom stalls that prevents embarrassment for both parties. A further object is to provide a portable lock for public bathroom stalls that secures closure where the door lock may be missing, broken or malfunctioning. The portable lock for public bathroom stalls may eliminate the need for a second person to hold the door.

A Port P Lock is disclosed herein in a first embodiment comprising a shatter-resistant housing (formed of two ½ housings), at least one biasing spring, at least one shaft, at least one retaining ring, at least one shatter-resistant cover, at least one magnet, and a flexible shaft. The shatter-resistant housing may hold the shaft, and the shaft may be attached to the biasing spring. The retaining ring may retain the shaft in position. The flexible shaft may be threaded through a hole in the shatter-resistant cover. The magnet may be attached to an underside of the shatter-resistant cover. The shatter-resistant cover may be attached to the shatter-resistant housing. The portable locking device is useful to keep a stall door in a public bathroom closed, as desired. The portable locking device may be extended from an edge of the stall door. The magnet holds the stall door closed during an in-use user determined condition, and the portable locking device for public bathroom stalls may be useful for securely closing the stall door in relation to a body of the public bathroom and alternately opening as per manipulation of a user.

A Port O Lock is also disclosed herein as a second (preferred) embodiment comprising a shatter-resistant housing, biasing spring, shaft, retaining ring, shatter-resistant cover, magnet, and a flexible shaft. The shatter-resistant housing holds the shaft, and the shaft is attached to the biasing spring. The retaining ring may hold the shaft in position as in the first embodiment. The flexible shaft may be threaded through a hole in the shatter-resistant cover. The magnet may be attached to an underside of the shatter-resistant cover. The shatter-resistant cover may be attached to the shatter-resistant housing. The portable locking device in a similar manner to embodiment one may be useful to keep a stall door in a public bathroom closed, as desired. The portable locking device may be extended from an edge of the stall door. The magnet holds the stall door closed during an in-use user-determined condition. The portable locking device further comprises a visual signal comprising a symbol, the symbol preferably comprises indicia, the indicia comprises ‘ ’ spelled alphanumerically as an indication of a ready-for-use condition and alternately an in-use condition. The portable locking device further comprises an object-holder-protrusion for storing keys therein, and the portable locking device for public bathroom stalls may be useful for securely closing the stall door in relation to a body of the portable bathroom and alternately opening as per manipulation of a user.

A port o lock in a third embodiment preferably comprises a shatter-resistant housing(s), biasing spring, shaft, retaining ring, shatter-resistant cover, magnet, and a chain. The shatter-resistant housing holds the shaft, and the shaft is attached to the biasing spring. The retaining ring holds the shaft in position. The chain may be threaded through a hole in the shatter-resistant cover. The magnet may be attached to an underside of the shatter-resistant cover. The shatter-resistant cover may be attached to the shatter-resistant housing(s). The portable locking device may be useful to keep a stall door in a portable bathroom closed, as desired. The portable locking device may be extended from an edge of the stall door. The magnet holds the stall door closed during an in-use user-determined condition, and the portable locking device for public bathroom stalls may be useful for securely closing the stall door in relation to a body of the portable bathroom and alternately opening as per manipulation of the user.

The present invention holds significant improvements and serves as a port o lock. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, port o lock, constructed and operative according to the teachings of the present invention.

The various embodiments of the present invention will hereinafter be described in conjunction with the appended drawings, wherein like designations denote like elements.

DETAILED DESCRIPTION

Figure 1A:
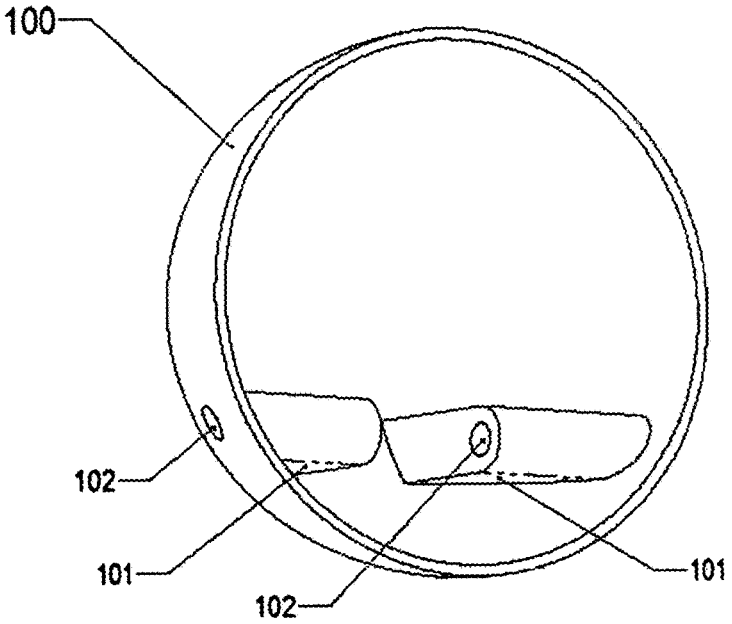
FIG. 1A shows a side perspective view of a shatter-resistant housing according to an embodiment of the present invention.
Figure 1B:
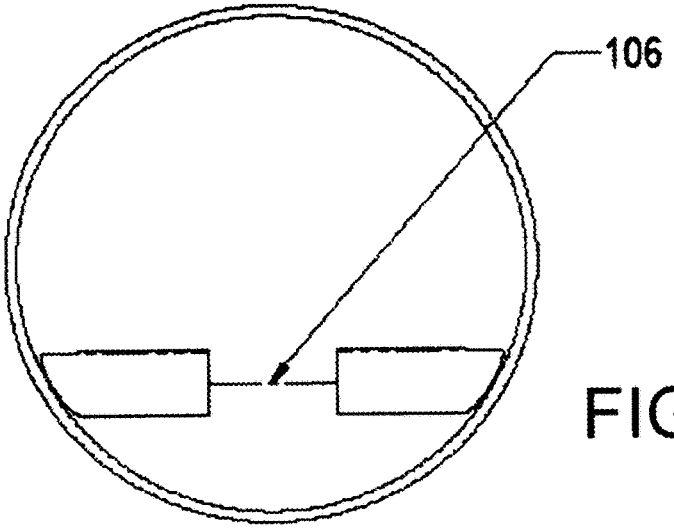
FIG. 1B shows a front view of the shatter-resistant housing according to an embodiment of the present invention.
Figure 2A:
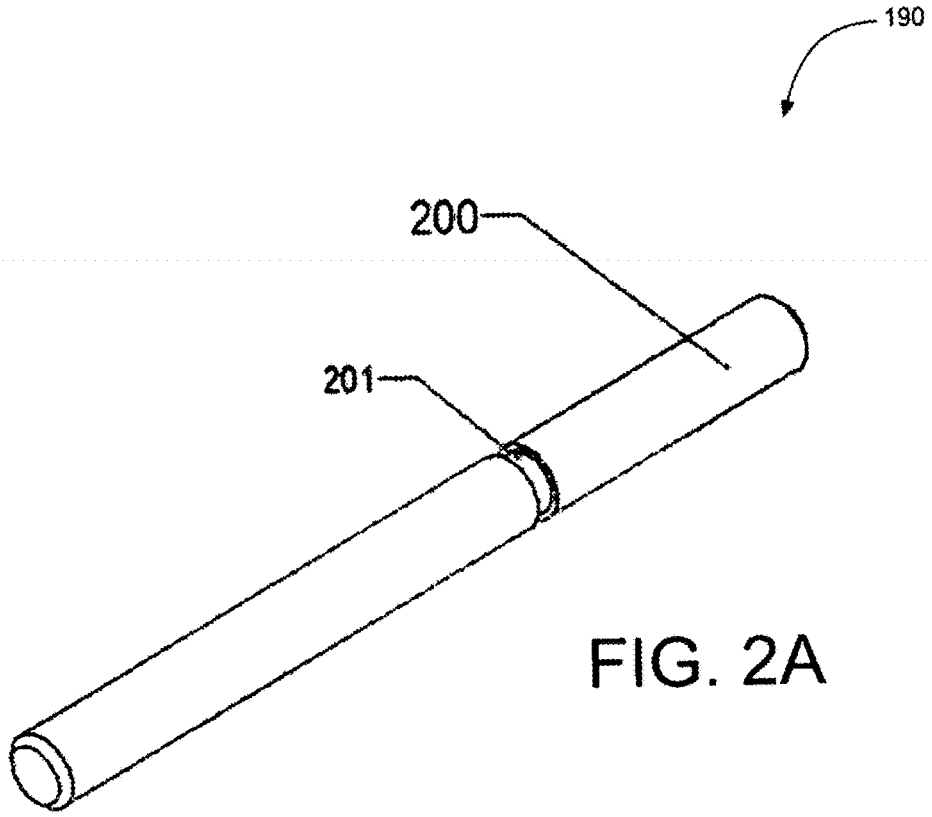
FIG. 2A shows a perspective view of a pin of the port o lock according to an embodiment of the present invention of FIGS. 1A and 1B.
Figure 2B:
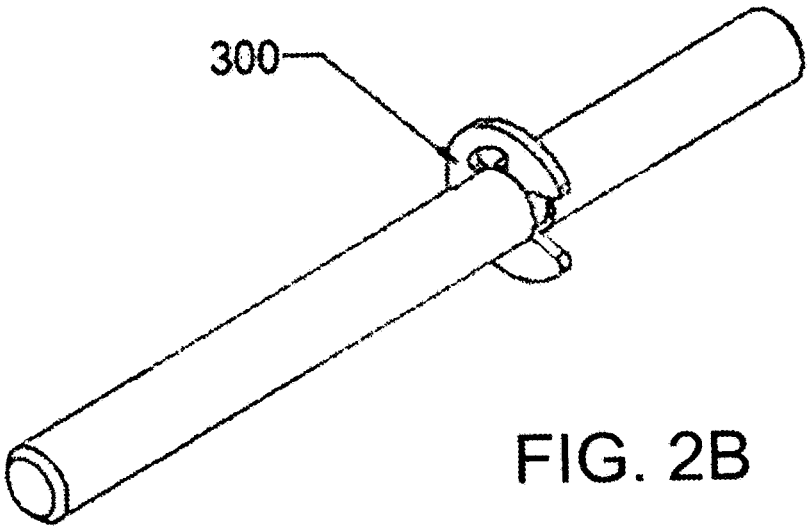
FIG. 2B shows a perspective view of the pin comprising a retaining ring according to an embodiment of the present invention of FIGS. 1A and 1B.
Figure 3A:
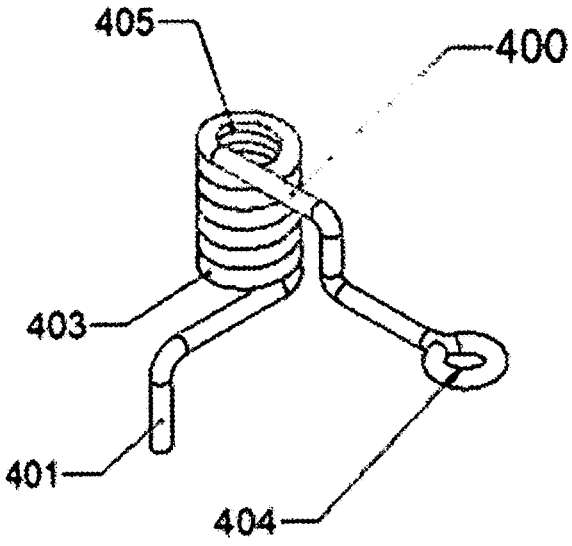
FIG. 3A shows a perspective view of a spring according to an embodiment of the present invention of FIGS. 1A-2B.
Figure 3B:
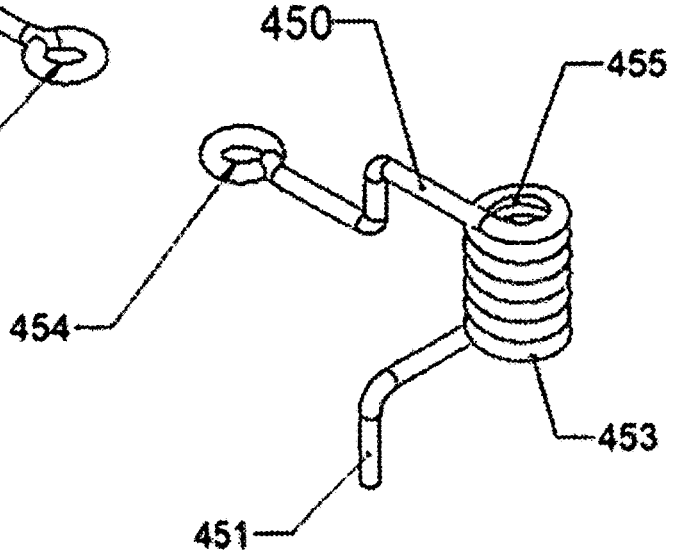
FIG. 3B shows another perspective view of a spring according to an embodiment of the present invention of FIGS. 1A-2B.
Figure 4:
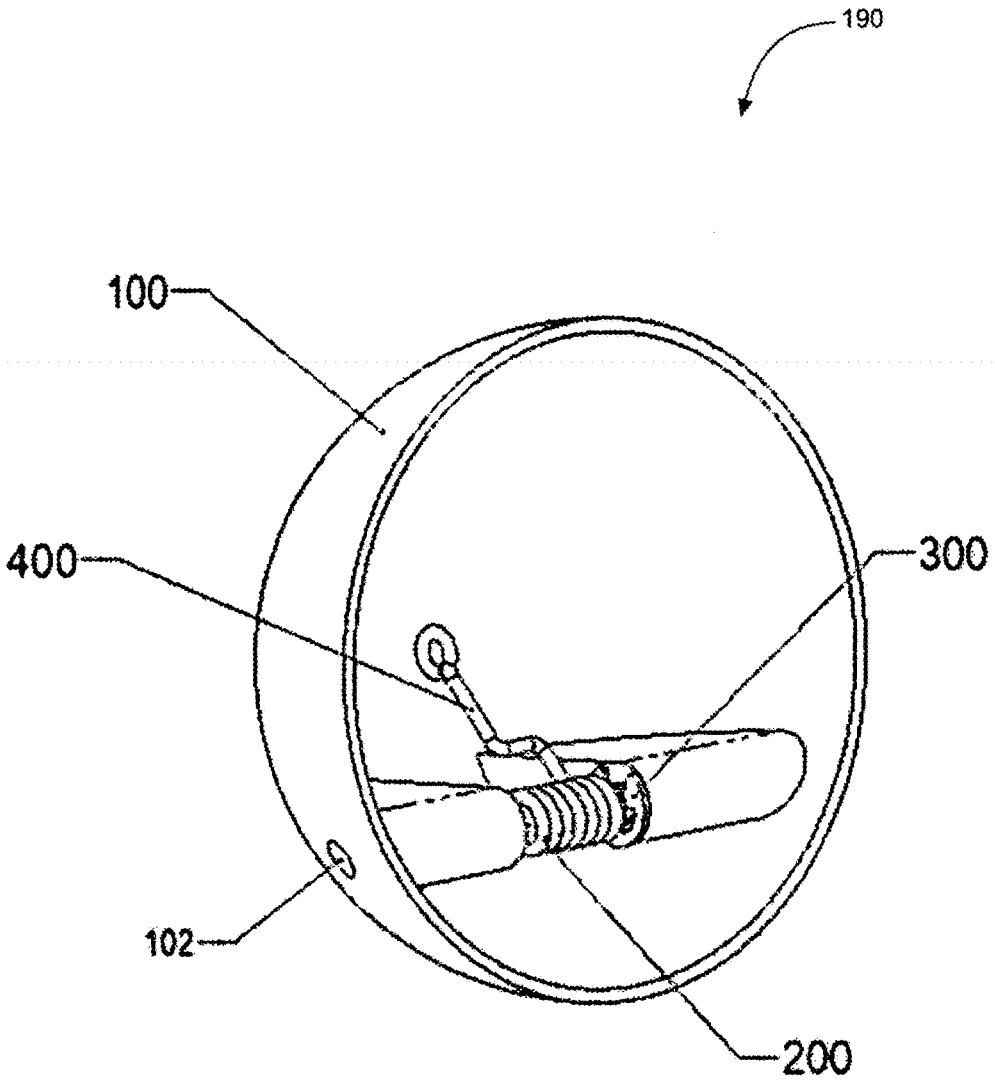
FIG. 4 shows a perspective view of the pin and the spring installed within the shatter-resistant housing according to an embodiment of the present invention of FIGS. 1A-3B.
Figure 5:
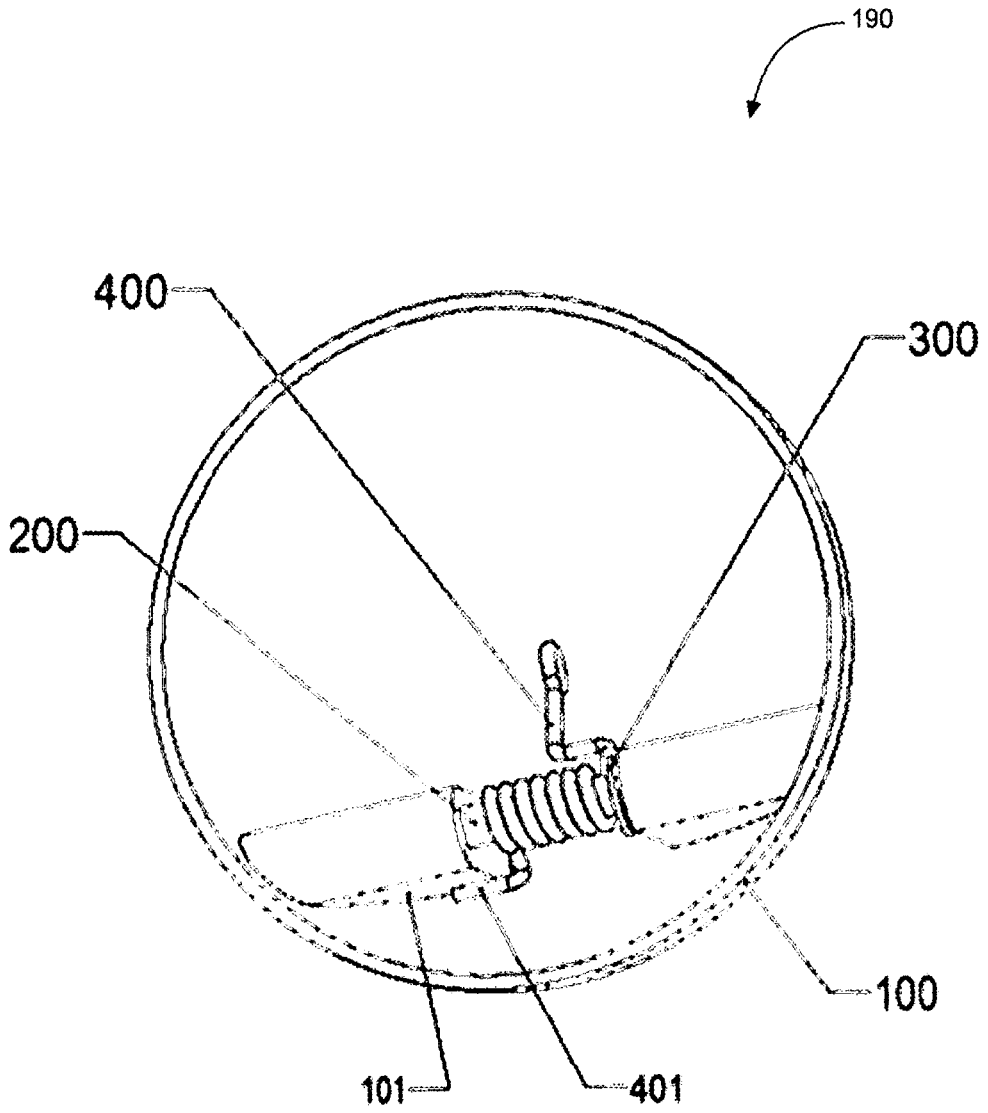
FIG. 5 shows a front view of the pin and the spring installed within the shatter-resistant housing according to an embodiment of the present invention of FIGS. 1A-4.
Figure 6:
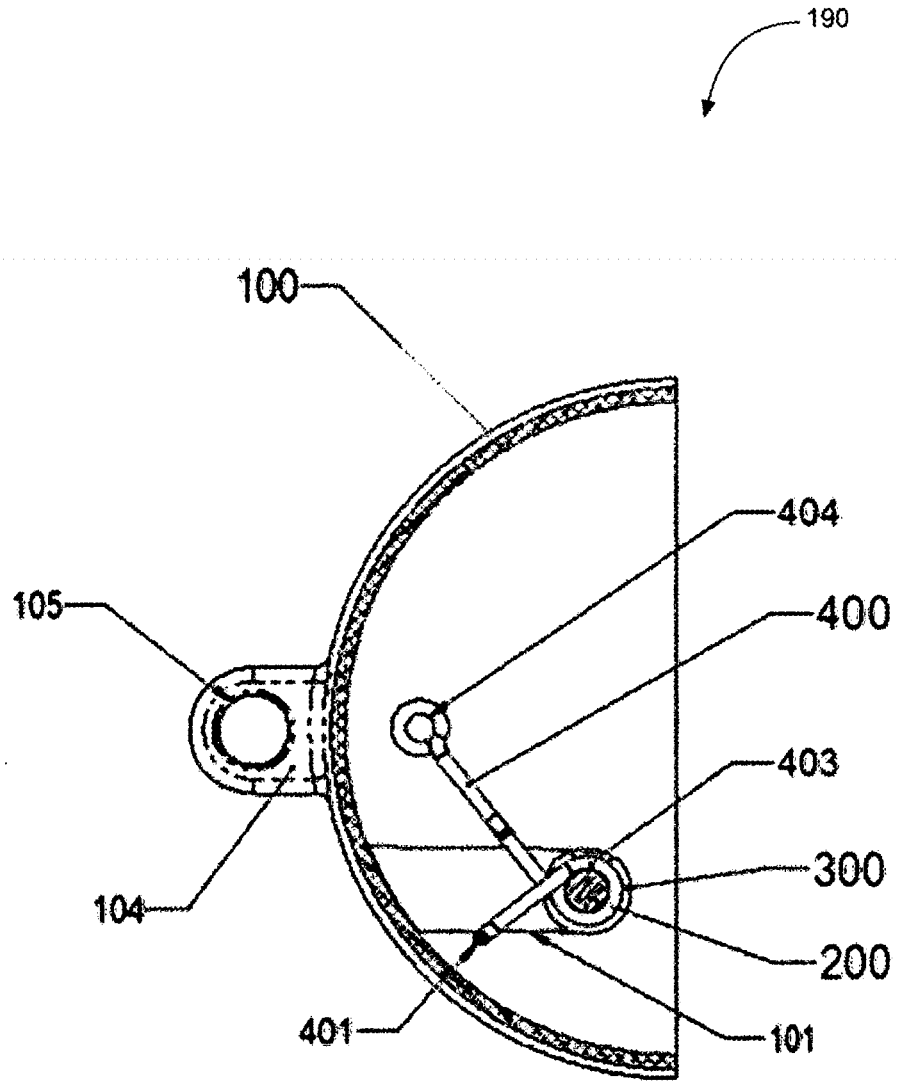
FIG. 6 shows a cross sectional view of the shatter-resistant housing and interior components according to an embodiment of the present invention.
Figure 7A:
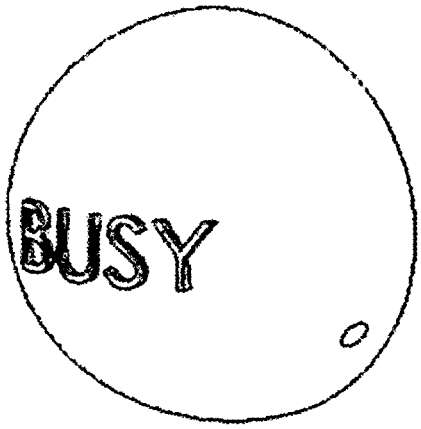
FIG. 7A shows a side perspective view of an outside of the shatter-resistant housing comprising indicia for indicating an 'in-use' condition of the port o lock according to an embodiment of the present invention.
Figure 7B:
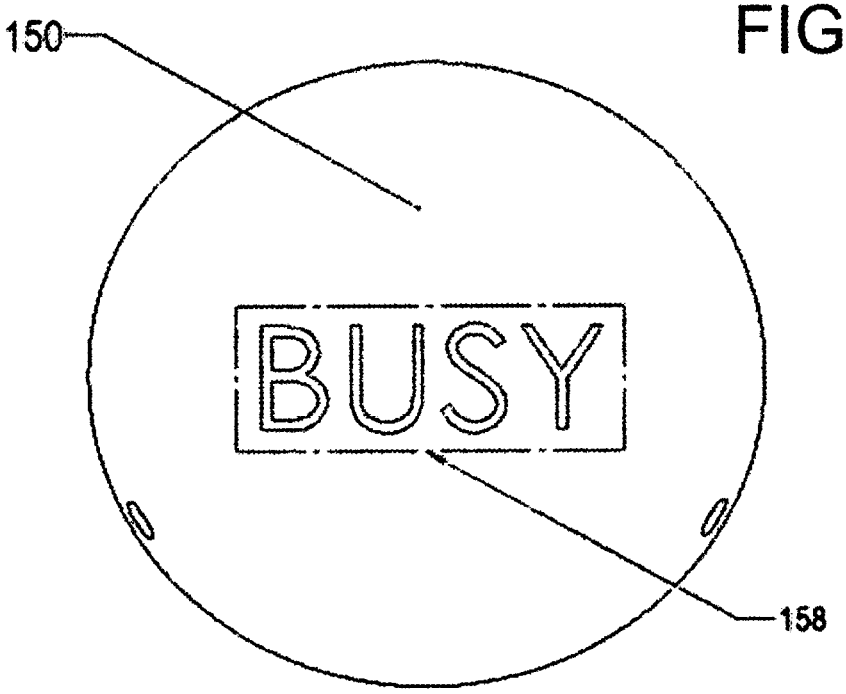
FIG. 7B shows a front perspective view of an outside of the shatter-resistant housing comprising indicia for indicating the 'in-use' condition of the port o lock according to an embodiment of the present invention.
Figure 8:
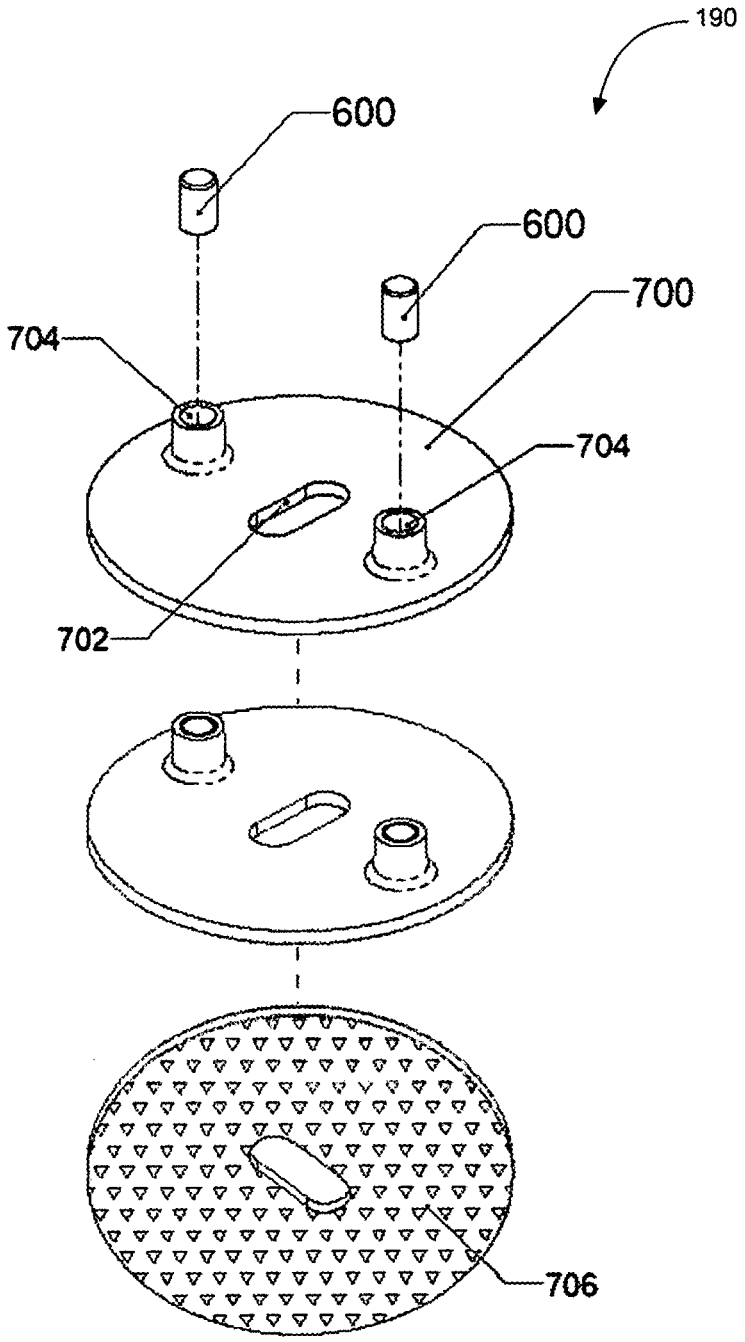
FIG. 8 shows a perspective view of a lid according to an embodiment of the present invention.
Figure 9A:
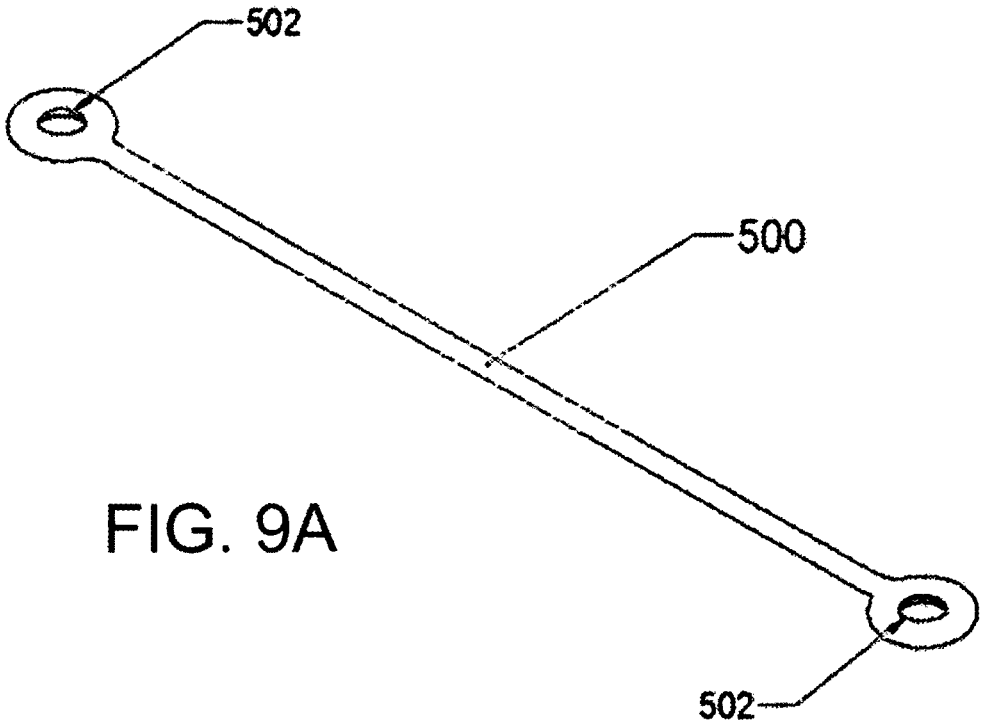
FIG. 9A is a perspective view illustrating a connection rod comprising two points at each end according to an embodiment of the present invention of FIG. 1.
Figure 9B:
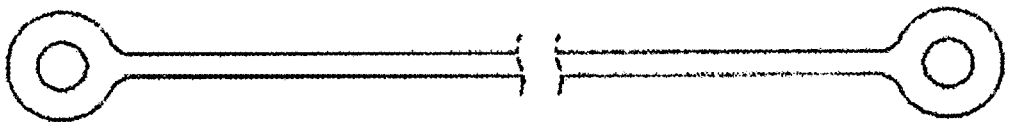
FIG. 9B is a perspective view illustrating the connection rod according to an embodiment of the present invention of FIG. 9A.
Figure 10:
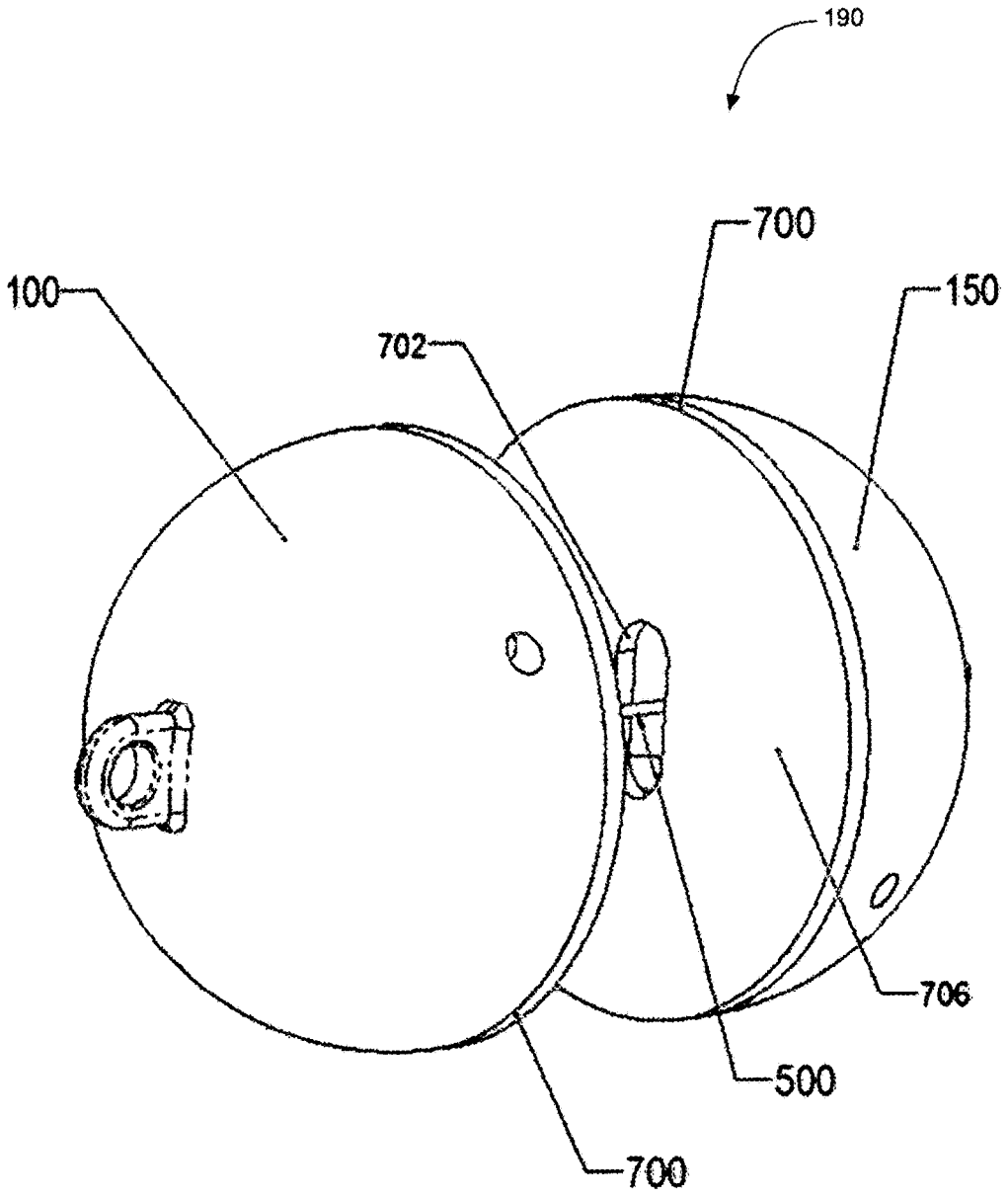
FIG. 10 is a perspective view illustrating a perspective view of an assembled port o lock according to an embodiment of the present invention.
Figure 11:
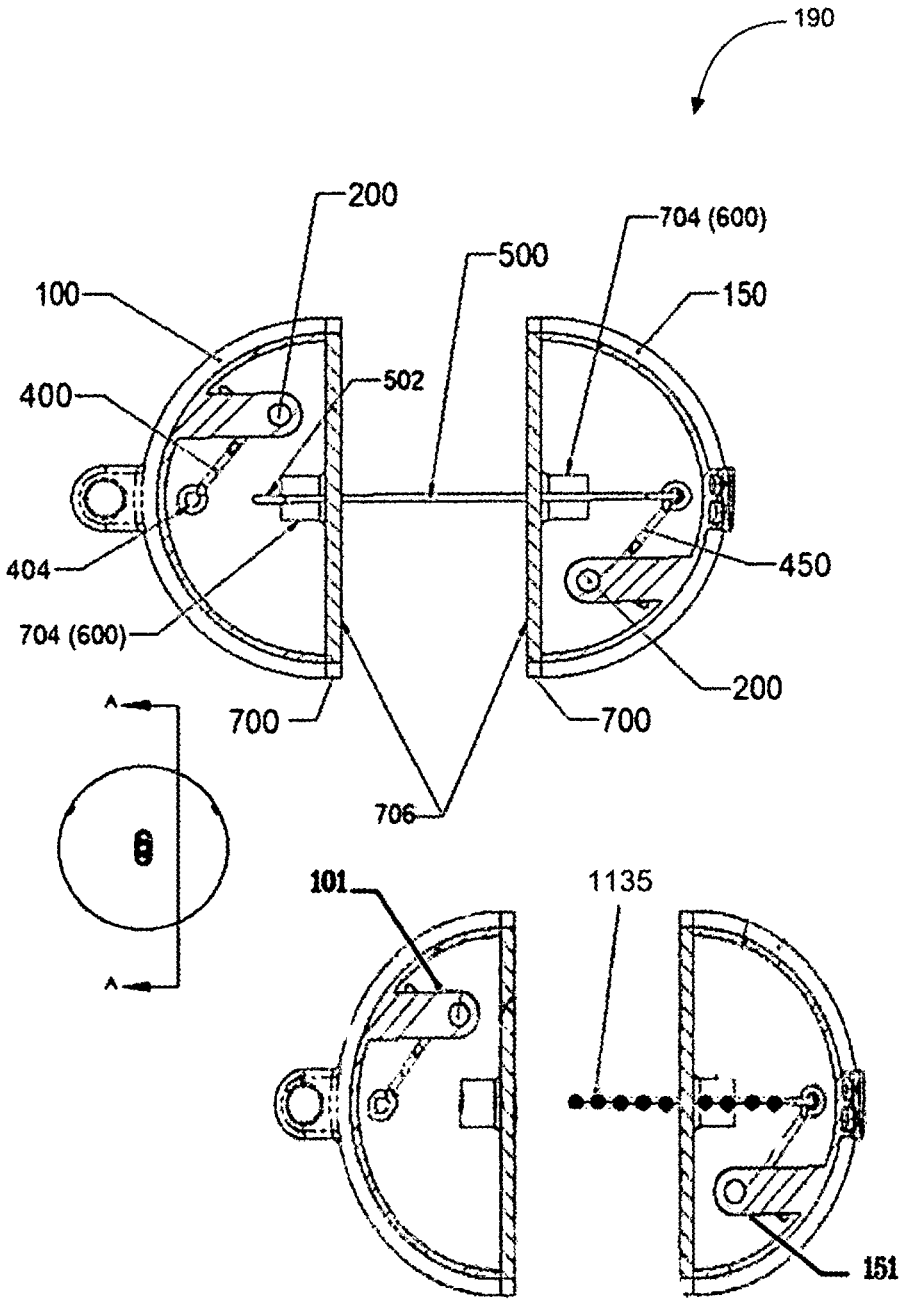
FIG. 11 is a perspective view illustrating a cross-sectional view of an assembled port o lock according to an embodiment of the present invention.

As discussed above, embodiments of the present invention relate to a Port O Lock and more particularly to a portable lock for public bathroom stalls as used to improve the ability for a user to apply a lock while using a public bathroom stall that provides a visual in-use condition to an exterior of the bathroom stall.

Generally speaking, the figures illustrate housings 100, 150 connected by connection rod 500 to springs 400, 450 pivoting on pins 200 retained by retaining rings 300. Magnets 600 installed into lids 700 provide simple closure before use and additional tension or mounting fixation in use. Housings 100, 150 are provided to allow installation of functional components and a comfortable and appealing shape for the invention. In this embodiment the housing is a somewhat hollow, half round shape for a comfortable handle and a visually appealing design. It is desirable that the present invention be comfortable for use and is designed with that in mind.

Through hole 102 extends through housings 100, 150 to provide for pin 200 mounting using hole. Surfaces 101, 151 provide for a pressure or contact surface for springs 400, 450 in use as well as structural integrity. Extension 104 and hole 105 provide for attachment to a key ring for example. Gap 106 provides a space for the spring. External surfaces may be marked to denote logo or text to be provided as suggested therein. While round was chosen for a comfortable and visually appealing shape, virtually any shape can be utilized without departing from the intent of the proposed invention. Housings 100, 150 may be constructed from two or more pieces each and snap together potentially eliminating the need for pins 200 retaining rings 300 and lids 700 and ease assembly as well. While housings 100, 150 may be molded in construction in any suitable color they can also be molded in a clear or translucent manner. In doing so a small circuit, battery and light (LED) that may blink while installed in use to provide a more attention to the device.

Pins are intended to provide positioning and an 'axle' for rotational movement of springs 400, 450 in use. Pins 200 are provided to rotationally mount the springs within housings 100, 150. As previously noted a variation of housing 100, 150 design can provide an alternate method of assembly and potentially eliminate the need for pins 200 and retaining rings 300.

Retaining Rings 300 provide a means to fix position of pins 200 within housings 100, 150 to prevent unintentional removal or loss of pins. These are preferably standard commercial E rings. They are popular and used frequently used to retain and position shafts. A variety of retaining rings 300 of this nature and purpose exist. One or more others could be accommodated without departing from the functional need for them in the present embodiment. Variations to housings 100, 150 as previously described could eliminate the need for pins 200 and retaining rings 300.

Springs 400, 450 provide a tension in use as is suggested in this invention. Springs 400, 450 connect to connection rod 500 in use. Two springs 400, 450 are provided and are mirror images of each other visually and functionally. While spring 400 may be wound clockwise, spring 450 would be wound counter clockwise to provide the same tension while being used on the opposite side housing 150. Springs 400, 450 as presented here provide a pivot means, tension means and a connection means from housing 100 to 150. Any manner of extension spring can be utilized without departing from the design intent. Similarly a rubber band can be used with proper accommodations in the design of the assembly.

Connection Rod 500 provides a means to connect the separate housings 100, 150 together for use. Connection rod 500 as shown able to be slipped onto springs 400, 450 at connection points 404, 454 through lids 700 at clearance holes 702 in assembly. Connection rod 500 can be any means or method capable of attaching and flexibly connecting the two housing assemblies 100, 150. As previously noted a wire strap or another spring can also be utilized with similar function in use.

Magnets 600 may provide an additional mounting means for use of the invention on steel public bathroom doors. They are secured in lids 700 before assembly. They are also used to keep the assembly compact and together in storage. These are industry standard Neodymium magnets 600 noted for their strong magnetic fields. They provide convenient closure to the assembly for storage in a woman's purse for instance. They also provide an additional means for securing the invention on metal doors. Use of magnets 600 in this embodiment is a functional requirement. The use of VELCRO® in its place may create the possibility of the assembly sliding down the doors in use, that is not desired.

Lids 700 enclose separate housings 100, 150 to prevent user's fingers from being snagged or otherwise injured in storage or use. They also provide bosses 704 for magnets 600 and clearance hole 702 for passage of connecting rod 500. Lids 700 are provided for closure to housings 100, 150 in assembly and also to prevent possible injury from movement of the internal parts of the assembly. Clearance hole 702 is provided for a connection means between two housings 100, 150 using connection rod 500. Bosses 704 are provided to easily retain the magnets 600 as described in this embodiment. A grip or sticky surface or material is provided on gripper surface 706 of lids 700 to secure the assembly from sliding out of view. As discussed previously design changes to housings 100, 150 could obviate the need for separate lids.

Housings 100, 150 provide an external appearance, and through holes 102 in a stronger molded boss 704 provide for pins 200 with groove 201 for retaining ring 300. Gaps 106, 156 provide an open mounting area or space for springs 400, 450 suitable wound 403, 453 which are rotationally mounted to pins 200 using clear areas 405, 455 through springs 400, 450. Surfaces 101, 151 provide a contact and pressure area to resist rotational movement of springs 400, 450 at points 401, 451 on the springs 400, 450. Connection points 404, 454 provide for connections to connection rod 500 at points 502. Magnets 600 are provided in lids 700 using bosses 704 for mounting and retaining. Clearance hole 702 is provided in lids 700 for movement of connection rod 500 in use and installation and gripper surface 706 is provided to secure the assembly in position while in use.

Some possible variations have been discussed previously, to add that one can use different configuration of levers, shell construction and hold of the types of springs 400, 450 and connection rods 500, chain 1135 may be used to create leverage in other manners to hold the tension. Suction cups could be used on opposite sides of the doors, wedges may be inserted to oppose motion.

Figure 12:
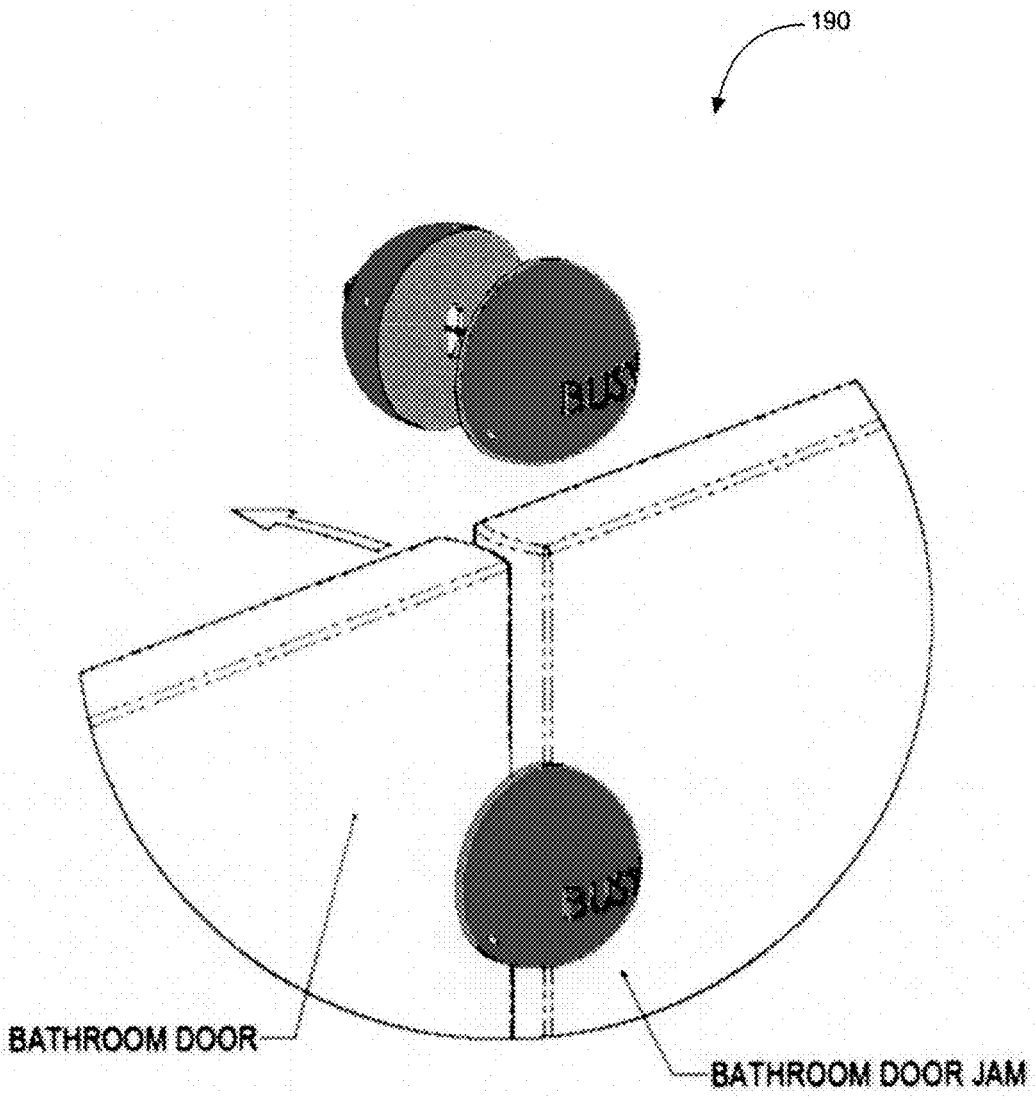
FIG. 12 is a perspective view illustrating a perspective view of the port o lock installed to a bathroom door according to an embodiment of the present invention.

Two housings 100, 150 are provided, they are connected together by connection rod 500 and tension is created by the action of springs 400, 450 in cooperation with housings 100, 150 and connection rod 500 when housings 100, 150 are manually separated. In FIG. 12, housings 100, 150 are manually separated to use, placing them under spring tension, then slipped past the gap between the door and the door jamb of a public bathroom stall to secure closure where a malfunctioning lock or closure may be missing. This would prevent embarrassment to both parties. When they are in a suitable and visible position they are released and the springs 400, 450 tension coupled with magnets 600 and gripper surfaces 706 holds them in position intended to be viewed and otherwise noticed from the outside. When required the invention is simply removed by reversing the procedure and stored for the next use. The invention is not intended to provide absolute closure and locking.

Referring now to the drawings more specifically by numerals of reference there is shown in FIGS. 1-12, various views of portable locking device for public bathroom stalls 190.

Portable locking device for public bathroom stalls 190 may further comprise a visual signal comprising a symbol. In one embodiment, the symbol may comprise indicia. Indicia may comprise "Busy" spelled alphanumerically as an indication of a not ready-for-use condition. Alternatively, indicia may comprise "OCCUPIED" spelled alphanumerically as an indication of 'in-use' condition. It should be noted that 'in-use' condition may include a locked condition to prevent unauthorized exterior-entry. Portable locking device for public bathroom stalls may further comprise an object-holder-protrusion. The object-holder-protrusion may be structured and arranged to hold keys. Furthermore, portable locking device for public bathroom stalls 190 may comprise a top-edge and a bottom-edge.

Further, portable locking device for public bathroom stalls 190 may comprise an object-holder-protrusion for holding keys. Portable locking device for public bathroom stalls 190 may be useful for securely closing stall door in relation to a body of public bathroom and alternately opening as per manipulation of user.

Portable locking device for public bathroom stalls 190 may further comprising a visual signal comprising a symbol. The symbol may comprise indicia, as mentioned previously. In one embodiment, the indicia may comprise "Busy" spelled alphanumerically as an indication of a not ready-for-use condition. Alternatively, indicia may comprise "Busy" spelled alphanumerically as an indication of 'in-use' condition. The "Busy" may be spelled alphanumerically in any language for use in any country. It should be noted that 'in-use' condition to prevent unauthorized exterior-entry.

In continuing to refer the third embodiment, portable locking device for public bathroom stalls 190 may further comprise an object-holder-protrusion. Object-holder-protrusion may be structured and arranged to hold keys. Furthermore, an edge of stall door may comprise a top-edge, and the edge of stall door may comprise a bottom-edge. As such, the present invention may be used to promote privacy during use of public bathroom stalls 190.

The present invention may comprise a kit for manufacture and sale. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different locking means and combinations thereof, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A portable locking device in combination with a bathroom stall door and an adjacent bathroom stall jamb, wherein the portable locking device holds the bathroom stall door in a closed position relative to the adjacent bathroom stall jamb when said portable locking device is in an in-use configuration, the portable locking device comprising: first and second housings, each of said first and second housings includes an inner space open to an end of said respective housing; first and second lids, each of said first and second lids at least partially covers the inner space of said first and second housings, respectively, at the end of said respective housing, wherein each of said first and second lids comprises at least one magnet; first and second springs mounted within the inner space of said first and second housings, respectively, wherein each of said first and second springs includes an extending arm having an end; a flexible member having first and second ends, wherein the first and second ends of said flexible member are coupled to the ends of the extending arms of the first and second springs, respectively, so as to connect the first and second housings to one another, wherein when the portable locking device is in the in-use configuration, the first and second housings are spaced from one another such that a thickness of the bathroom stall door and the adjacent bathroom stall jamb is received between the first and second housings and such that at least a portion of the flexible member is received in a space between the bathroom stall door and the adjacent bathroom stall jamb, and wherein the at least one magnet of each of the first and second lids is magnetically attracted to at least one of the bathroom stall door and the adjacent bathroom stall jamb so as to hold the bathroom stall door in the closed position when the portable locking device is in the in-use configuration.

2. The portable locking device of claim 1, wherein said flexible member is in the form of a flexible shaft or a chain.

3. The portable locking device of claim 1, wherein each of the first and second lids comprises a clearance hole through which the first and second ends of the flexible member extend so as to couple with the extending arms of the first and second springs, respectively.

4. The portable locking device of claim 1, wherein the at least one magnet comprises two magnets.

5. The portable locking device of claim 4, wherein each of said first and second lids includes two bosses, and wherein each magnet is received in a corresponding one of the bosses.

6. The portable locking device of claim 1, wherein one of said first and second housings comprises indicia.

7. The portable locking device of claim 6, wherein said indicia comprises the word "Busy" spelled alphanumerically on an external surface of the one of said first and second housings as an indication of the in-use configuration of the portable locking device.

8. The portable locking device of claim 1, wherein one of said first and second housings comprises an object-holder protrusion having a through hole.

9. The portable locking device of claim 8, wherein said object-holder protrusion is configured to hold a set of keys.

10. The portable locking device of claim 1, wherein each of said first and second lids includes a gripper surface in contact with at least one of the bathroom stall door and the adjacent bathroom stall jamb when the portable locking device is in the in-use configuration.

11. The portable locking device of claim 1, wherein said first and second lids are shatter-resistant.

12. The portable locking device of claim 1, wherein said first and second housings are shatter-resistant.

13. The portable locking device of claim 1, wherein each of said first and second housings is semi-spherical in shape.

14. The portable locking device of claim 1, wherein said first and second springs are torsion springs.

15. The portable locking device of claim 14, wherein each of said first and second springs comprise a wound portion connected to the extending arm.

16. The portable locking device of claim 15, wherein each of said first and second springs are mounted to each of the first and second housings, respectively, by a pivot pin extending through the wound portion.

* * * * *